US005887562A

United States Patent [19]

von Esebeck et al.

[11] Patent Number: 5,887,562

[45] Date of Patent: Mar. 30, 1999

[54] INTERNAL-COMBUSTION ENGINE WITH INDEPENDENT MODULE SUBASSEMBLY

[75] Inventors: Goetz Freiherr von Esebeck, Berlin; Rolf Duerrstein, Bietigheim; Martin Weindorf, Kornwestheim, all of Germany

[73] Assignees: Daimler-Benz AG; Filterwerk Mann & Hummel GmbH, both of Germany

[21] Appl. No.: 898,503

[22] Filed: Jul. 22, 1997

[30] Foreign Application Priority Data

Jul. 22, 1996 [DE] Germany ..... 196 29 210.7

[51] Int. Cl.[6] ..... F01M 5/00

[52] U.S. Cl. ..... 123/196 AB; 123/196 R; 123/41.33

[58] Field of Search ..... 123/196 AB, 196 A, 123/198 C, 41.01, 41.33

[56] References Cited

U.S. PATENT DOCUMENTS

| | | | |
|---|---|---|---|
| 3,486,582 | 12/1969 | Carter et al. | 184/6.3 |
| 4,245,593 | 1/1981 | Stein | 123/142.5 R |
| 4,249,491 | 2/1981 | Stein | 123/142.5 R |
| 4,258,676 | 3/1981 | Lamm | 123/142.5 R |
| 4,348,991 | 9/1982 | Stang et al. | 123/41.29 |
| 4,399,774 | 8/1983 | Tsutsumi | 123/41.1 |
| 4,487,364 | 12/1984 | Okulicz et al. | 237/12.3 R |
| 4,512,299 | 4/1985 | Egan et al. | 123/196 A |
| 4,648,363 | 3/1987 | Kronich | 123/196 R |
| 5,196,746 | 3/1993 | McCabria | 310/54 |
| 5,682,851 | 11/1997 | Breen et al. | 123/196 A |

FOREIGN PATENT DOCUMENTS

| | | |
|---|---|---|
| 0 252 035 A2 | 3/1987 | European Pat. Off. . |
| 30 48 449 A1 | 10/1981 | Germany . |
| 196 19 977.8 | 5/1996 | Germany . |

*Primary Examiner*—Erick R. Solis
*Assistant Examiner*—Hai Huynh
*Attorney, Agent, or Firm*—Evenson, McKeown, Edwards & Lenahan, P.L.L.C.

[57] ABSTRACT

An internal-combustion engine has an oil pump, preferably also the cooling water pump, assigned to an independent module which can be mounted separately.

1 Claim, 1 Drawing Sheet

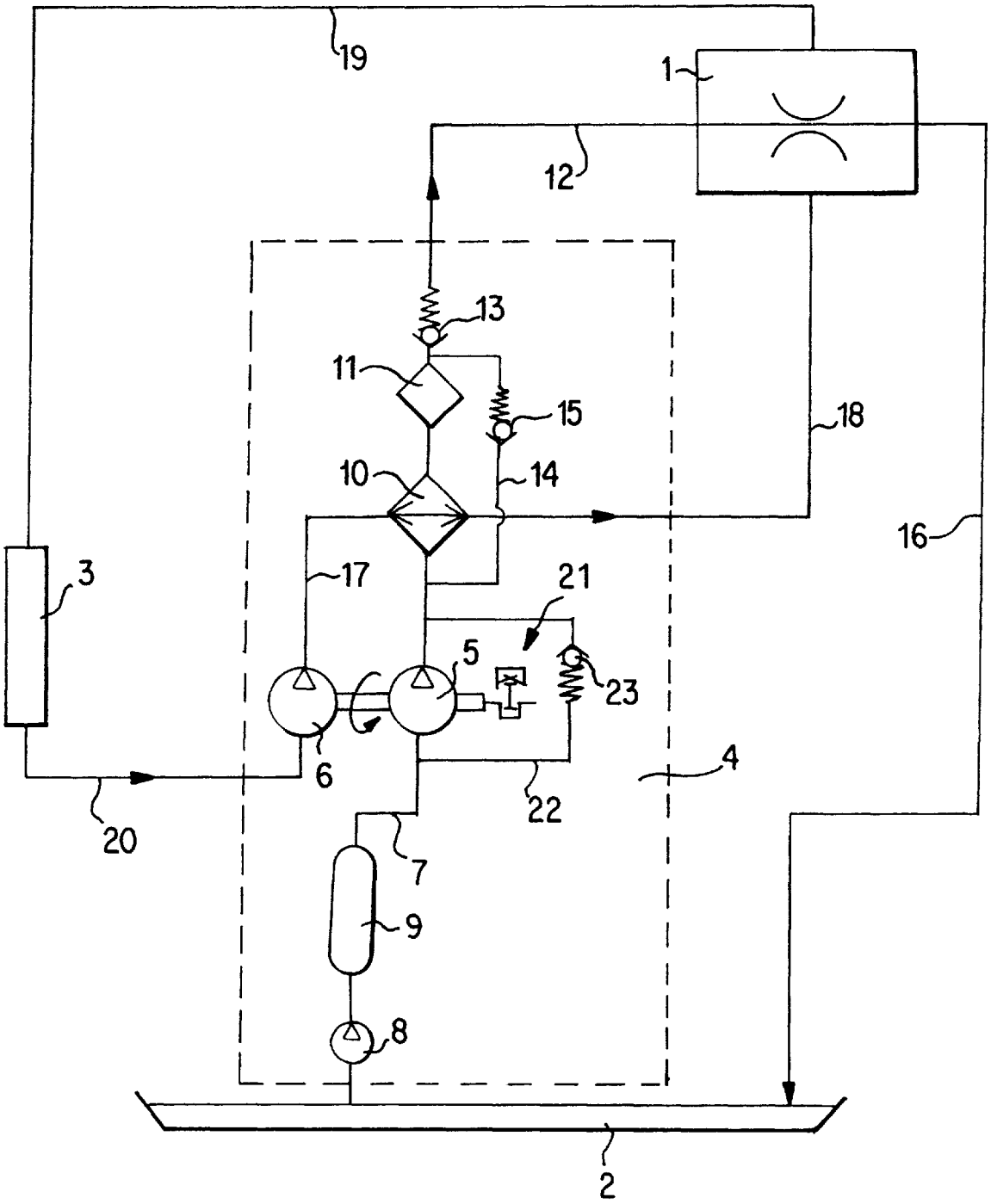
19
1
12
13
11
15
18
10
14
16
3
17
21
5
23
6
4
22
20
7
9
8
2

INTERNAL-COMBUSTION ENGINE WITH INDEPENDENT MODULE SUBASSEMBLY

BACKGROUND AND SUMMARY OF THE INVENTION

This application claims the priority of 196 29 210.7, the disclosure of which is expressly incorporated by reference herein.

The present invention relates to an internal-combustion engine, and more particularly to an engine having a cooling circulating system, an oil lubrication system, an oil cooler connected to the cooling circulating system and an oil pan receiving the oil sump, the oil filter, the oil pump and the oil cooler being combined as a subassembly in a separable component of the internal-combustion engine.

An internal-combustion engine is referred to in German Patent Application 196 19 977.8-13, corresponding to U.S. Ser. No. 08/858,338 filed on May 19, 1997 in the name of Goetz FREIHERR VON ESEBECK et al. for INTERNAL-COMBUSTION ENGINE, in which the oil filter, the oil pump and the oil cooler are arranged as a subassembly in the oil pan accommodating the oil sump. Although this additional utilization of the oil pan permits extensive preassembling, as well as assembly simplification, in view of the special requirements of the respective engine and also the mounting conditions for this engine, differentiated requirements occur specifically in the oil pan area. This, in turn, causes multiple shapes and developments of the oil pan with a corresponding adaptation of the components integrated in the oil pan. In addition, the space conditions also do not always permit corresponding developments of the oil pan, and particularly in the case of modern engines, a very flat development of the oil pan is also desired.

In view of the above, an object of the present invention is to achieve a construction which results in more extensive efficiencies.

According to the invention, this object has been achieved by providing a subassembly which forms an independent module. As the result, usage possibilities are permitted for a module on all types of different engines while the construction of the module is basically unchanged, particularly if standardized connections of the module are desired with the respective engine.

Efficiency and simplification effects are improved within the scope of the present invention in that the module containing the subassembly additionally comprises the coolant pump. As a result, simplifications and savings are also obtained in the drive(s) of the module units.

In order to, on one hand, be able to provide a construction of the oil pan which is as flat as possible and, on the other hand, to ensure the oil supply of the module also in the case of oil pans of many different configurations and, with the smallest volume of the oil sump accommodated by the oil pan, when this module is arranged separately from the oil pan and is possibly also in an unfavorable position with respect thereto, an initial oil pump is advantageously assigned to the module in the oil pump connection to the oil sump. Behind this initial oil pump, an intermediate storage device pertaining to the module is assigned to the module.

The concentration of the pumps in the module makes it possible to simplify the driving connections to the pumps, in particular, to also integrate them in the module and, in the case of the branching-off of the drive from that of the internal-combustion engine to require only one branching. However, within the scope of the invention, the module may also have an independent drive source such as, for example, an electric motor.

BRIEF DESCRIPTION OF THE DRAWING

Other objects, advantages and novel features of the present invention will become apparent from the following detailed description of the invention when considered in conjunction with the accompanying sole figure wherein the sole FIGURE is a schematic diagram of the cooling and oil circulating system of an internal-combustion engine in accordance with the present invention.

DETAILED DESCRIPTION OF THE DRAWING

The lubrication points of an internal-combustion engine are designated by reference numeral 1, the oil pan of the internal-combustion engine is designated by numeral 2 and engine coolers are designated by numeral 3. These above-mentioned functionally linked elements of the internal-combustion engine form a module 4, which is assigned as an independent constructional unit to the internal-combustion engine and in which an oil pump 5 is situated in the oil circulating system of the internal-combustion engine and a coolant pump 6 is situated in the cooling circulating system of the internal-combustion engine.

A line path 7 connects the oil pump 5 with the oil sump represented by the oil pan 2. In line 7, an initial oil pump 8 and an intermediate storage device 9 are situated as parts which relate to the module 4. The intermediate storage device 9 is situated between the initial oil pump 8 and the oil pump 5. The oil pump 5 supplies the oil, via an oil cooler 10 and a filter 11 (preferably a main current filter), to the lubrication points 1 through a line path 12, which contains a return flow stop 13 in the form of a return valve downstream of the filter 11.

Between the oil cooler 10 which is situated in the line path 12 following or downstream of the oil pump 5 and following the filter 11, the line path 12 can be bridged by a bypass line 14 in which a pressure control valve 15 is situated which opens in the direction of the lubricating points 1 and which simultaneously acts as a return flow stop. Thereby, in the event of defects in the oil cooler and/or with clogging of the filter 11, the oil pump 5 can continue to deliver lubricating oil to the lubrication points 1 while bypassing these defective or non-operating parts, while a flowing-through in the opposite direction is prevented by the return function of the pressure control valve 15.

The valve 13 used as the return flow stop between which and the filter 11 the bypass line 14 branches off the line path 12 prevents an emptying of the lubricating oil lines and thus a running-dry of the lubrication points 1 in the starting phase of the engine. After flowing through the lubrication points 1, the oil flows the return line 16 back into the oil pan 2 or into the oil sump represented thereby.

The linking of the oil circulating system and of the cooling circulating system for cooling the lubricating oil takes place by way of the oil cooler 10. This oil cooler 10 follows the coolant pump 6 in the delivery direction of the pump 6 connected by way of the line 17. The oil cooler 10 allows the coolant to flow through a line 18 into the internal-combustion engine cooling circuit represented here by the lubrication points 1. From the internal-combustion engine, the return flow takes place by way of the return line 19 to the cooler 3, from which the coolant pump 6 takes in returning coolant through line 20.

A drive 21 for the oil pump 5 and the coolant pump 6, provides driving power from an independent drive source or the like assigned to the module or, also within the contemplation of the present invention, from a driving connection branched off the internal-combustion engine. If the branching-off of the driving power takes place by way of a corresponding connection to the internal-combustion engine, only a driving connection is needed with the corresponding branchings to be carried out within the module 4. This also applies with respect to the drive of the initial pump 8, which can also optionally take place by an independent drive source pertaining to the module 4 within the scope of the present invention. Moreover, if the oil pump 5 and the coolant pump 6 are driven jointly, a separate control or regulating possibility for these two pumps is advantageous.

A bypass line 22 is assigned to the pump 5 and, while bridging the pump 5, connects the line paths 7, 12. A pressure control valve 23 is arranged in the bypass line 22 so as to block in the opposite direction, i.e., from line path 7 to line path 12. The bypass line 12 implements an internal regulation of the pump 5 so that, with an excessive delivery of the oil pump 5, a return flow to its suction side can occur.

The module 4 can be connected with the internal-combustion engine at any point, and the module 4 can be assigned to different internal-combustion engines if the outputs of the respective module are suitable for this purpose. The necessary adaptations can be achieved without changes on the module itself but only in connection thereof to the internal-combustion engine. Thereby, while using modules which are staggered with respect to their output, a large number of different internal-combustion engines can be equipped whereby corresponding efficiency effects are obtained. In addition, without an intervention into the internal-combustion engine, the most varied constructional requirements with respect to the internal-combustion engine for its accommodation in different vehicles can also be taken into account in a simple manner.

The integration of an intermediate storage device 9 into the module 4 permits an oil pan configuration which is as flat as possible or a displacement of the oil storage volume from the internal-combustion engine and thus a minimization of the size of the internal-combustion engine. In addition, a simplification in the crankcase ventilation is also achieved with the present invention because, as the result of the reduction of the oil volume in the oil sump, the oil foaming with the corresponding disadvantages with respect to the output of the internal-combustion engine is reduced. In addition, the corresponding ventilation, to the extent that it is required, can also be assigned to the module. The modular construction is also particularly advantageous with respect to the use of different materials for the internal-combustion engine housing and the housing of the module 4.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Internal-combustion engine having a cooling circulating system including an oil lubrication system, an oil cooler connected to the cooling circulating system and an oil pan arranged to receive an oil sump, wherein an oil filter, an oil pump, a coolant pump, an initial oil pump, and an intermediate storage device arranged downstream of the initial oil pump between the oil sump and the oil pump, and the oil cooler comprising the oil lubrication system being combined as a subassembly forming an attached independent module of the internal-combustion engine situated outside the oil pan, wherein a drive connection to the internal-combustion engine is assigned to the module, and a drive source comprising the module is operatively arranged for the oil pump and the coolant pump.

* * * * *